United States Patent [19]

Ford

[11] 4,352,433

[45] Oct. 5, 1982

[54] ROD AND BRACKET ASSEMBLY

[75] Inventor: James A. Ford, Sherman Township, St. Joseph County, Mich.

[73] Assignee: Kirsch Company, Sturgis, Mich.

[21] Appl. No.: 103,777

[22] Filed: Dec. 14, 1979

[51] Int. Cl.[3] ..... A47H 1/02

[52] U.S. Cl. ..... 211/105.1; 248/262

[58] Field of Search ..... 211/105.1–105.3; 52/36; 248/262, 263, 221.4; 160/330; 16/94 R, 94 D, 96 R, 96 D; 403/326

[56] References Cited

U.S. PATENT DOCUMENTS

| | | | |
|---|---|---|---|
| 1,801,477 | 4/1931 | Ainsworth | 248/105.3 |
| 1,965,124 | 7/1934 | Kenney | 248/263 |
| 2,234,260 | 3/1941 | Kirsch | 211/105.3 |
| 2,498,623 | 2/1950 | Poupitch | 248/221.4 X |
| 3,387,321 | 6/1968 | Janus | 248/262 X |
| 3,429,452 | 2/1969 | Johnson | 248/105.3 |

*Primary Examiner*—Ernest R. Purser

*Attorney, Agent, or Firm*—Blanchard, Flynn, Thiel, Boutell & Tanis

[57] ABSTRACT

A rod and bracket assembly for supporting a curtain or drapery and having rod means capable of extending through, and holding in an upright manner, a wide hem at the upper end of a drapery or curtain, whereby to simulate a valance at said upper end. End cap means are connected to the ends of said rod and are removably attachable to appropriate hook means on brackets, which are mountable on a wall. Thus, said end cap means provides the connecting means between said brackets and said rod and facilitate the mounting of the curtain onto said rod without snagging and provides an attractive termination for the ends of such rod.

15 Claims, 11 Drawing Figures

ROD AND BRACKET ASSEMBLY

FIELD OF THE INVENTION

The invention relates to a rod and bracket assembly for supporting a curtain or drapery having a relatively wide upper hem and particularly relates to such an assembly having a rod for holding said hem in a substantially vertical position and one which is quickly and easily insertable into such hem and attachable and detachable from supporting brackets.

BACKGROUND OF THE INVENTION

In the pending application of Elvira Caroselli, U.S. Ser. No. 009,284, filed Feb. 2, 1979, and entitled "Valance and Drapery Assembly", there is set forth and claimed a novel concept in the provision of a relatively wide valance extending through a correspondingly wide hem at the upper end of a drapery for supporting said hem in an upstanding position and providing for the drapery the distinctive and attractive appearance characteristics associated with such wide hem. Said application is licensed exclusively to the assignee of the present application.

The subject matter of said pending application is well conceived and fully capable of carrying out its purposes. However, as same was studied for manufacturing and distribution, a number of improvements over the prior art, from the standpoint of assembly and shipping, were developed which it is the purpose of the present invention to cover.

Particularly, the assembly set forth in said pending application incorporates integral, transverse end brackets which are space-consuming for the proper containment thereof and which also render difficult the application thereto of the hem of a drapery. This occasioned both undesirable space requirements in shipping and undersirable inconvenience in applying a drapery thereto when same reached the ultimate customer.

Accordingly, the objects of the invention include:

1. To provide an improved design for a rod and bracket assembly as set forth in the above-identified pending Caroselli application which will reduce the amount of space required for shipment of same while preserving the basic characteristics and advantages of the drapery mounting structure set forth in said pending application.

2. To provide an improved drapery rod, as aforesaid, which will include improved means for inserting the valance portion thereof into the hem of a drapery while maintaining the space-saving features above mentioned and maintaining also the basic appearance and desirable features of the original Caroselli design.

3. To provide an improved rod assembly, as aforesaid, which will be of such simplicity as to involve a minimum of construction cost.

4. To provide a rod assembly, as aforesaid, which can be readily put together by the ultimate user with only simple instructions and with a minimum of effort.

5. To provide an improved rod assembly, as aforesaid, which will be sturdy and therefore long lasting with a minimum of maintenance attention.

Other objects and purposes of the invention will be apparent to persons acquainted with devices of this general sort upon reading the following specification and inspection of the accompanying drawings.

DETAILED DESCRIPTION

Figure 1:
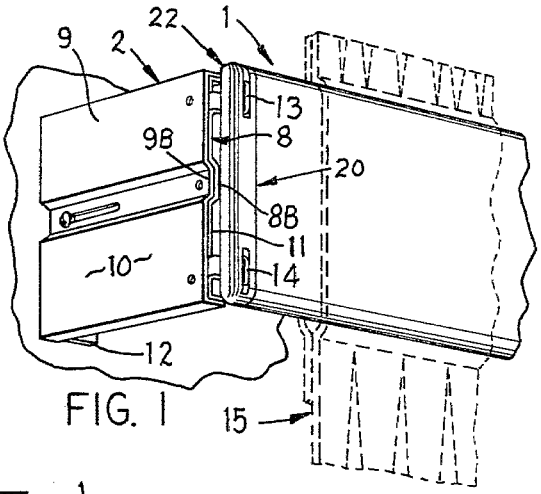
FIG. 1 is an oblique view of a portion of a rod and bracket assembly embodying the invention mounted upon a wall and indicating schematically the attachment of a drapery thereto.
Figure 3:
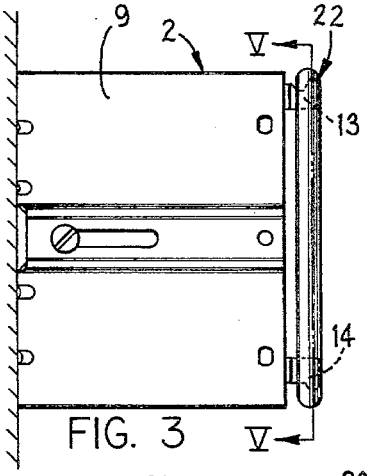
FIG. 3 is an end view of said rod and bracket assembly.

Referring now to the drawings in detail, there is shown a rod 1 having end caps of which one is shown at 20 and hereinafter further described, said rod being by means of said end caps detachably mounted onto a pair of end brackets of which one appears at 2. The other end bracket, not shown, is provided at the other end of the rod and is a mirror image of the end bracket 2. Said end brackets are mounted upon a vertical surface, as a wall, in any convenient manner, as by screws 5. A curtain or drapery 15 (FIG. 1) has a wide hem at its upper edge which is sleeved upon the rod 1 and simulates a valance, even though it is part of the curtain.

Figure 11:
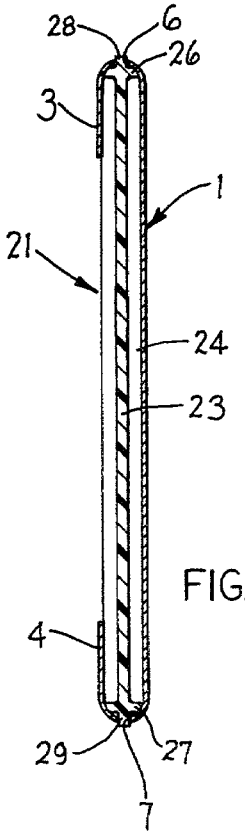
FIG. 11 is a section taken on the line XI—XI of FIG. 4.

Said rod 1 is preferably of rolled or extruded metal, as aluminum or steel, either of which may be plastic coated if desired and/or otherwise coated or finished in any desired conventional manner, usually anodized if aluminum or enameled or otherwise coated if steel. The said rod 1 has upper and lower reversely curved flanges 3 and 4 both for effecting proper engagement with the hem of said drapery 15 and also for engagement with the hereinafter-described end caps 20. Said rod is also provided with upper and lower slots adjacent each end, such as the upper and lower slots 6 and 7 (respectively) as appearing in FIG. 11.

Figure 2:
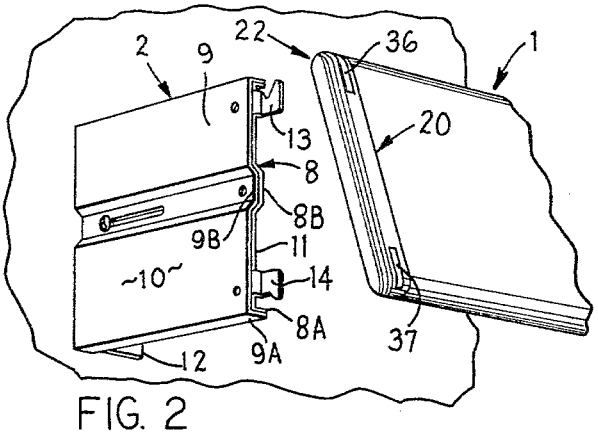
FIG. 2 is an oblique view of said portion of a rod and bracket assembly with the rod in position for a final attachment thereof to the supporting bracket.
Figure 7:
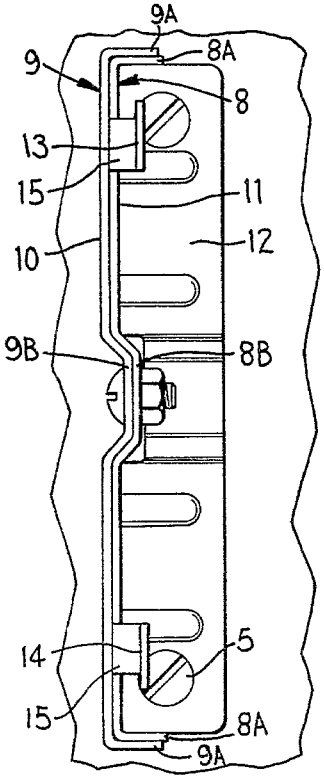
FIG. 7 is an edge view of bracket.
Figure 8:
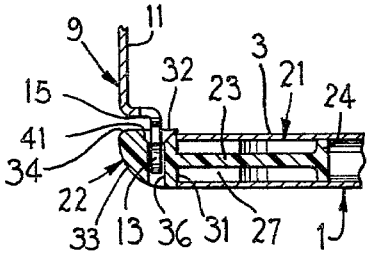
FIG. 8 is a sectional view taken on the line VIII—VIII of FIG. 4.
Figure 9:
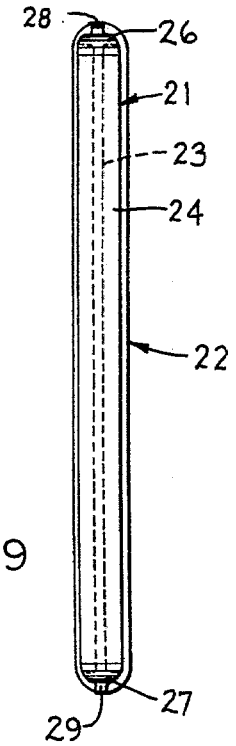
FIG. 9 is an end elevational view of said rod.
Figure 6:
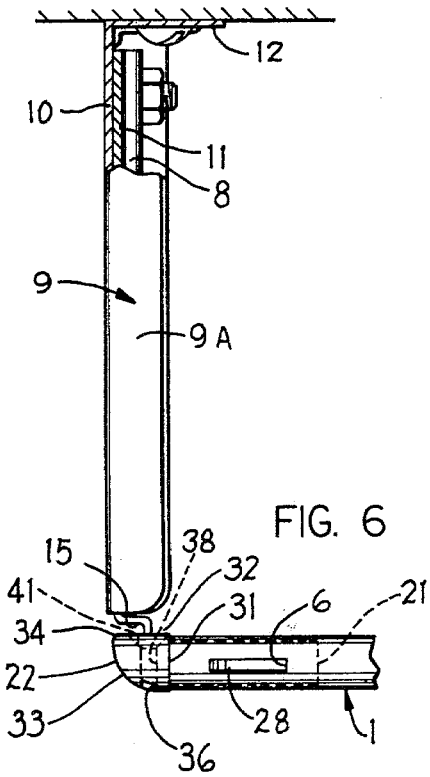
FIG. 6 is a broken, top view of the bracket with a fragment of the rod applied thereto.

Said bracket 2 preferably comprises a pair of substantially parallel components 8 and 9 (FIGS. 2 and 7). The component 9 comprises a support plate 10 and a mounting flange 12, said mounting flange 12 providing for the mounting of said bracket onto a vertical surface, as a wall, in any convenient manner. The component 8 comprises an extension plate 11 having oppositely extending hooks 13 and 14 at the front edge thereof. Suitable means, as screws or bolts, extend through said plate 11 and also through an appropriate slot in the plate 10 of the component 9 for adjustment of said component 8 toward or away from the wall as desired, followed by securement in a selected adjusted position.

The rod supporting hooks 13 and 14 are integral with the edge of said plate 11 remote from the wall and may if desired extend coplanar with said plate 11. However, it is preferable to have same offset as shown (FIGS. 1, 6, 7 and 8) in order that the hereinafter-described end cap may overlap the lateral portions 15 thereof as hereinafter further set forth. The hooks are shaped in any known manner for engagement with appropriate portions of the end caps as hereinafter further described. The components 8 and 9 (FIG. 7) are preferably provided with interfitting reinforcement flanges 8A and 9A and reinforcing guide grooves 8B and 9B as desired.

As above noted, the bracket provided at the rightward end of the rod is a mirror image of the bracket 2 and, hence, no detailed description thereof is needed, excepting to note that the base plate 9 may be made as a universal component usable at both ends while the extension plates 8 will need to be made as mirror image, right and left hand units.

Figure 5:
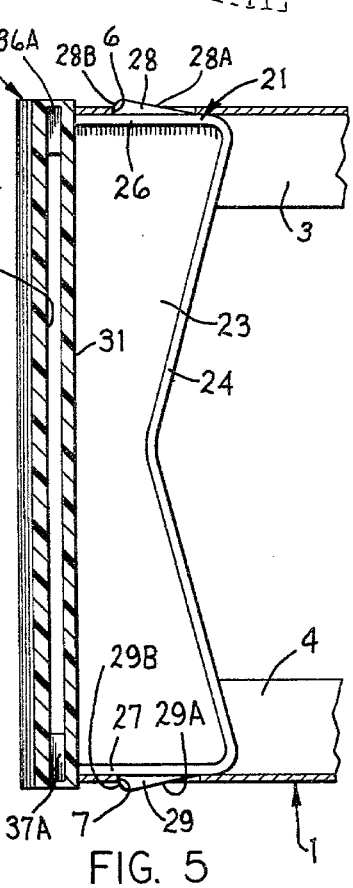
FIG. 5 is a section taken along the line V—V of FIG. 3.

Each of the end caps 20 (FIGS. 5 and 6) comprises a plug or mounting portion 21 and a cover portion 22. Said plug portion 21 comprises in vertical cross section (FIG. 11) a generally I-shaped member having a central web 23, a top flange 26 and a bottom flange 27. In horizontal cross section (FIG. 8) same defines a generally T-shape comprising said web 23 and a side flange 24. Said top and bottom flanges are further provided with upper and lower locking projections 28 and 29, respectively, for cooperation as hereinafter further described with the slots 6 and 7, respectively, of the rod 1. Said projections have sloped edges 28A and 29A, respectively, for effecting easy entrance of said projections into said slots. Said projections also having locking end surfaces 28B and 29B for holding same firmly within said slots upon completion of entry thereinto.

Figure 4:
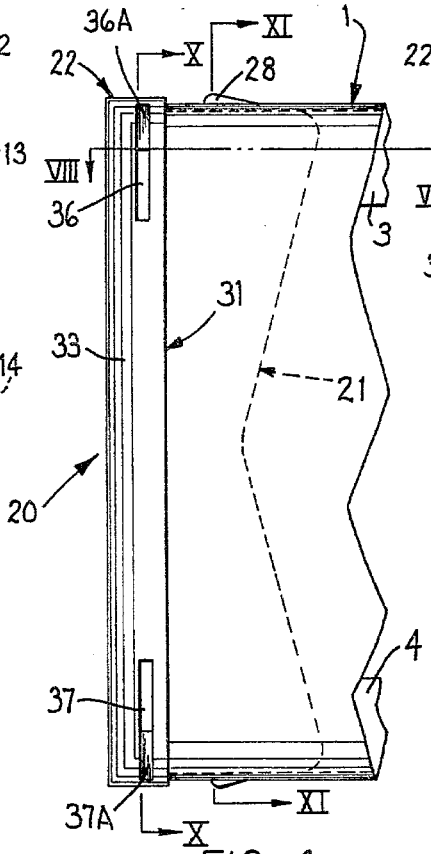
FIG. 4 is an enlarged fragment of a front elevational view of the rod of said assembly.
Figure 10:
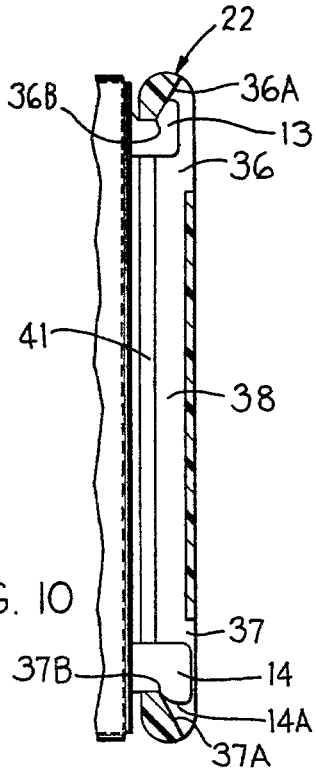
FIG. 10 is a section taken on the line X—X of FIG. 4.

Upper and lower slots 36 and 37 (FIGS. 4 and 10) are provided as shown through said cover portion 22 for receiving the hooks 13 and 14, respectively. If desired, for the purpose of minimizing requirements for plastics material, same may be connected by an elongated slot 38. Respective upper and lower surfaces of said slots 36 and 37 are flared as indicated at 36A and 37A (FIG. 10) to provide edges 36B and 37B engageable by the hooks 13 and 14. In order to assist in leading said hooks into said slots 36 and 37, the ends of said slots facing the bracket 2 are also flared as indicated at 41 in FIG. 8. The lower edge 14A (FIG. 10) of the hook 14 is so contoured with respect to the edge 37B, and having in mind the resiliency of the plastics material being used for said end cap, that, when the upper hook 13 is fully engaged, the lower hook 14 will pass over the edge 37B in either direction with a slight resistance to such movement. It will thus snap into position over the edge 37B as shown in FIG. 10 or be removable therefrom when desired.

Thus, the end cap 20 is firmly, but removably, secured both to the rod 1 and to the bracket 2 for forming a firm, sturdy assembly fully capable of supporting the drapery in the manner desired.

The cover portion 22 of said end cap 20 is arranged both to close and cover the otherwise raw end of said rod 1 and is also arranged to cover in an attractive manner the otherwise exposed end of the bracket 2. In this embodiment, as is preferable, said cover portion 22 has a flat surface 31 perpendicular to and wider than the width of the adjacent plug portion 21 and arranged to abut the adjacent end of the rod 1. Said cover portion 22 also has a rear surface 32 positioned substantially perpendicular to the surface 31. The remote edges of the surfaces 31 and 32 are connected by a surface of any attractive contour, here a generally arcuate surface 33, which is preferably slightly rounded at 34 where it meets with the surface 32. Said cover member 22 along with the surfaces 31 and 32 are so arranged and proportioned that when said plug portion 21 is inserted into an end of the rod 1 with the surface 31 positioned snugly against the end of said rod, the surface 32 of said cover portion will overlap and cover the surface 15 of the end bracket 2.

There is a corresponding plastic end cap (not shown) at the rightward end of the rod 1, said corresponding cap being a mirror image of, but usually slightly larger than, the cap 20 above described. The increased size of said corresponding end cap is required to fit snugly within the somewhat larger outside section of a typical, two-piece adjustable rod.

In use, said plastic end caps 20 are inserted into the rod 1 from each end thereof with the projections 28 and 29, and their counterparts on the rightward end cap, snapping respectively into the slots 6 and 7 of said rod and into corresponding slots on the rightward end of said rod. With the end caps 20 thus fixed in position, said rod is passed through the hem of the drapery. The end cap, regardless of the direction in which said rod is passed through said hem, functions to ease said passage through such hem and to prevent snagging of the hem by the raw end of the rod.

The rod, by means of the end caps, is now attached to the supporting hooks 13 and 14 of the end bracket 2 together with the corresponding hooks on the end bracket at the rightward end of the rod in the manner already above described. The assembly is now complete. If desired, the hem of the drapery may be pulled around onto either or both of the brackets for it will be noted that there is nothing at the corner structure or on such brackets to interfere therewith.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for the support of a drapery by extension thereof through a hem at the top of said drapery, comprising:

elongated straight rod means having rearwardly projecting flanges along the upper and lower edges thereof;

an end bracket attachable to a supporting surface and having plate means with a pair of remotely facing top and bottom hooks projecting beyond the outer edge of said plate means; and an end cap fixedly but releasably attached to said rod means and being slidable therewith through the hem of said drapery, the end cap having a first portion inserted between adjacent ends of said flanges for supporting said rod means and a second portion arranged for covering both the adjacent end of said rod means and said outer edge of said plate means, said end cap including slot defining means for receiving and removably retaining said hooks.

2. A device according to claim 1, wherein the rod means has a substantially planar front wall of substantial height such that the portion of the drapery sleeved thereon gives the appearance of a valance.

3. A device for the support of a drapery by extension thereof through a hem at the top of said drapery, comprising:

elongated rod means having reversely bent flanges along each of the top and bottom edges of said rod means;

an adjustable end bracket attachable to a supporting surface and having plate means with a pair of remotely facing top and bottom hooks projecting beyond the outer edge of said plate means; and an end cap having a first portion insertable between adjacent ends of said reversely bent flanges for supporting said rod means and a second portion arranged for covering both the adjacent end of said rod means and said outer edge of said plate means, said end cap including slot defining means for receiving and removably retaining said hooks.

4. The device of claim 3, wherein said top hook has and retains a locked relationship with said slot defining means when and after said bottom hook is moved into hooked engagement with said slot defining means.

5. The device of claim 3, wherein said hooks are parallel with said plate means, but offset therefrom toward the center of the rod means.

6. The device of claim 3, wherein said end cap is provided with a first face lying against and covering the end of said rod means and a second face substantially perpendicular to said first face for overlapping and covering the outer edge of said end bracket adjacent said end of said rod means.

7. The device of claim 6, wherein said end cap includes also a curved surface connecting the edge of said first face remote from said end bracket with the edge of said second face remote from said rod means whereby to facilitate the passage of said rod means through said hem and further to facilitate the passage of said hem beyond said rod means and onto said end bracket.

8. The device of claim 3, wherein said first portion has a central web extending from the said second portion and flange means extending along the free edges of said web, whereby said first portion is generally I-shaped in vertical cross section and is generally T-shaped in horizontal cross section.

9. The device of claim 8, including a pair of projections extending from the upper and lower edges of said first portion and parallel with said web for reception into appropriate slots in said rod means whereby said end cap is releasably secured to said rod means.

10. A device for the support of a drapery by extension thereof through a hem at the top of said drapery, comprising:

a straight elongated rod having a channel-like cross-sectional profile, said rod including a substantially planar front wall and upper and lower flanges projecting rearwardly therefrom;

an end bracket attachable to a supporting surface and projecting outwardly therefrom, said bracket being of a plate-like construction and having a pair of vertically spaced top and bottom hooks projecting forwardly away from the support surface; and one-piece end cap means fixedly but releasably attached to the free end of said rod means for facilitating the slidable insertion of said rod means through the drapery hem;

said end cap means including a cover portion disposed directly adjacent the free end of said rod means for closing and covering said free end, said cover portion having a surface which substantially abuts and directly overlies the free end surface of the rod means, said cover portion as it projects longitudinally outwardly from the free end of said rod means being provided with an exterior surface configuration which is rounded to facilitate its slidable insertion through the hem, said cover portion having a cross-sectional profile as viewed in a direction perpendicular to the longitudinal direction of said rod means which approximately corresponds to the profile enclosed by the cross-sectional configuration of said rod means, said cover portion being free of any projections which would project sidewardly therefrom significantly beyond the cross-sectional profile of said rod means so as to not interfere with the slidable insertion of the cover portion and rod means through said hem;

said cover portion having slot means formed therein and opening rearwardly thereof for receiving therein said upper and lower hooks for permitting said end cap means to be rigidly but releasably mounted on said bracket, said cover portion having a rear wall which covers the adjacent outer end of said bracket;

said end cap means also having a mounting portion which is fixed to said cover portion and projects longitudinally therefrom so as to be disposed in overlapping relationship with a portion of said rod means as disposed adjacent the free end thereof, said mounting portion being slidably telescopically engaged with said flanges and being disposed in its entirety behind the front wall of said rod means, said mounting portion having a cross section as viewed perpendicular to said longitudinal direction which does not exceed the cross section of said cover portion so as to not interfere with the slidable insertion of the end cap and rod means through said hem, said detent means coacting between said mounting portion and said flange for fixedly but releasably attaching said end cap means to said rod means.

11. A device according to claim 10, wherein said cover portion does not longitudinally overlap said rod means, and wherein said cover portion has a front surface which is substantially flush with the front surface of said front wall.

12. A device according to claim 11, wherein said detent means includes an opening formed in said flange at a location spaced inwardly from the free end of said rod means, and a camlike projection formed on said mounting portion which resiliently snaps into said opening when the mounting portion is slidably telescopically engaged with said flanges.

13. A device according to claim 10, wherein said detent means includes an opening formed in said flange at a location spaced inwardly from the free end of said rod, and a camlike projection formed on said mounting portion, said camlike projection resiliently snapping into said opening when the mounting portion is slidably telescopically engaged with said flanges.

14. A device according to any one of claims 10–13, wherein said end cap means is an integral one-piece member formed of a plastics material.

15. A device according to claim 10, wherein the front wall of the rod is of substantial height such that the portion of the drapery sleeved thereon gives the appearance of a valance.

* * * * *

UNITED STATES PATENT AND TRADEMARK OFFICE

CERTIFICATE OF CORRECTION

PATENT NO. : 4 352 433

DATED : October 5, 1982

INVENTOR(S) : James A. Ford

It is certified that error appears in the above—identified patent and that said Letters Patent is hereby corrected as shown below:

Col. 2, line 19; change "of bracket" to ---of the bracket---.

Col. 6, line 38; change "said detent means" to ---and detent means---.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*